US005382343A

United States Patent [19]

Zwerner

[11] Patent Number: 5,382,343

[45] Date of Patent: Jan. 17, 1995

[54] ELECTROLYTIC COATING CELL

[75] Inventor: Eric Zwerner, Commugny, Switzerland

[73] Assignee: EESA Electroplating Engineers S.A., Le Mont S/Lausanne, Switzerland

[21] Appl. No.: 983,554

[22] Filed: Feb. 8, 1993

[30] Foreign Application Priority Data

Jun. 11, 1991 [CH] Switzerland ..... 01734/91-9

[51] Int. Cl.[6] ..... C25D 17/00; C25D 17/14

[52] U.S. Cl. ..... 204/224 R; 204/225; 204/237; 204/275; 204/278

[58] Field of Search ..... 204/206, 224 R, 225, 204/275, 277-278, 237

[56] References Cited

U.S. PATENT DOCUMENTS

| | | | |
|---|---|---|---|
| 4,348,267 | 9/1982 | Shimamura | 204/206 |
| 4,683,045 | 7/1987 | Murata et al. | 204/206 |
| 4,879,015 | 11/1989 | Adamek et al. | 204/224 R |
| 4,952,296 | 8/1990 | Wingenfeld et al. | 204/206 |
| 5,116,480 | 5/1992 | Palnik | 204/224 R X |
| 5,223,110 | 6/1993 | Nolan | 204/224 R |

*Primary Examiner*—Donald R. Valentine
*Attorney, Agent, or Firm*—Nixon & Vanderhye

[57] ABSTRACT

A plating head includes a prismatic body containing a series of ducts connected via a supply duct to a source of pressurized electrolyte, and a series of ducts connected via a discharge channel to a suction source provided by a venturi in which a partial vacuum is generated by the flow of pressurized electrolyte through a branch duct.

13 Claims, 2 Drawing Sheets

ELECTROLYTIC COATING CELL

BACKGROUND OF THE INVENTION

1. Field of the Invention

This invention relates to an electrolytic coating cell for the purpose of forming a coating in the form of a longitudinal track on a band of metal substrate intended for connection to the negative pole of a source of current, comprising a plating head having the form of an elongated prismatic body, a longitudinal portion at least of said prismatic body being formed of a metal section intended for connection to the positive pole of the source of current, the outer surface of said metal section being covered with a layer of impregnable material, a series of ducts distributed along the prismatic body and opening near the layer of absorbent material, an electrolyte supply source, an electrolyte supply circuit, a supply circuit for said series of ducts, a pump for circulating the pressurized electrolyte from the source through the supply circuit, means for bringing said metal substrate into contact with a longitudinal portion of the layer of absorbent material covering said metal section and means for producing longitudinal movement between said head and said substrate in order to form said longitudinal track.

2. Related Art

There are known electrolytic plating cells of this type for electroplating a predetermined area of a plurality of metal pieces arranged side by side to form an electrically continuous band. Such a band may be produced, for example, by stamping and cutting a strip of metal so as to form a succession of distinct laminated pieces transversal to the strip, in particular electrical connectors, attached to a marginal area of the strip and intended for subsequent removal in order to separate the distinct pieces.

Given the fact that one reason for electroplating the contact area of the connectors is to give said area greater resistance to corrosion and ageing, precious metals are preferably used, in particular gold, silver or palladium and their alloys with common metals. Owing to the high price of such metals, an effort is made to limit the extent of the plated area to the active portion of the connectors.

For example, there are plating cells in which a metal substrate is circulated continuously in the form of a band connected to the negative potential of a source of current to form the cathode, while a portion of the substrate's surface is placed in contact with the surface of a flexible, porous material impregnated with an electrolytic solution in contact with an anode. During the course of said movement, the portion of the substrate in contact with the electrolytic solution is covered with an electroplated coating whose thickness depends on the length of contact time and the electrolysis parameters, in particular the composition of the coating solution and the plating conditions (temperature, current density, etc.).

Such a cell is described, for example, in document EP-A-195.781 (ROBBINS & CRAIG) wherein a band of vertically oriented connectors circulates horizontally and rubs against a belt of flexible, porous material, for example a foam of synthetic resin, in particular of polyurethane; said belt itself circulating in such a manner that the active galvanic solution that impregnates it is continually replaced.

In an embodiment such as the one described above, it is difficult to limit the plating area to a mid-portion of the connectors. Consequently, other embodiments have been proposed, in particular the use of a plating head comprising an elongated prismatic block inserted into a sleeve of porous material impregnated with electrolyte solution. The pieces to be plated are placed longitudinally in contact with an edge of the prismatic block, the angle of the latter determining the width of the portion of porous sheet in contact with the pieces and, thus, the extent of the plated area of said pieces. An illustration of such an embodiment may be found in FIGS. 9, 10 and 11 of reference document EP-A 222 232.

SUMMARY OF THE INVENTION

This invention provides an improved electrolytic coating cell in which there is a plating head with a first and second series of ducts and wherein has a suction source connected to the second series of ducts. Other features of the invention are described in the following description and accompanying drawings.

BRIEF DESCRIPTION OF THE DRAWINGS

As an example, the accompanying drawing schematically illustrates the state of the art as well as a form of execution and variations of the plating cell according to this invention.

DETAILED DESCRIPTION OF EXEMPLARY EMBODIMENTS OF THE INVENTION

Figure 1:
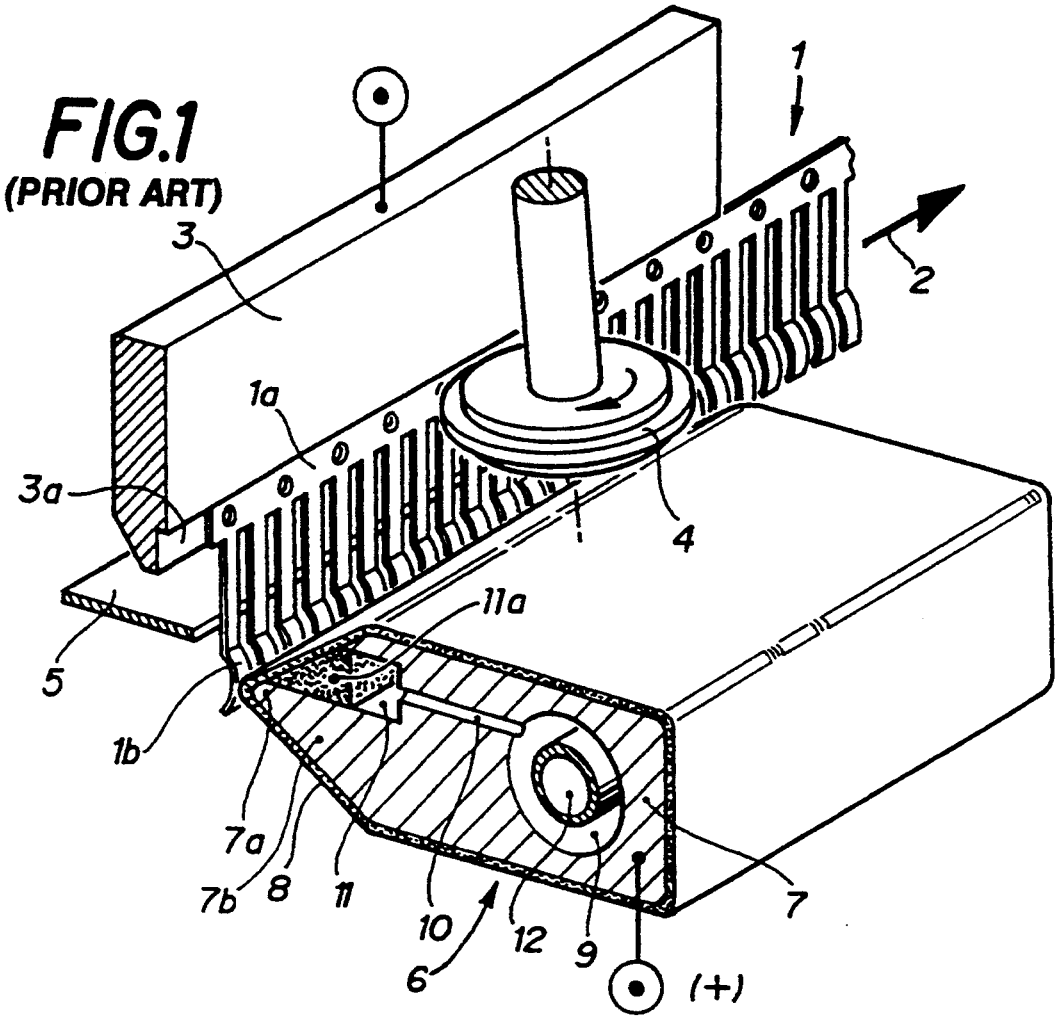
FIG.1 (PRIOR ART)
FIG. 1 is a perspective view with a partial cutaway of a detail of a plating cell according to the prior art.

FIG. 1 schematically represents some essential components of a cell for plating bands of connectors for electronics; such cells are available commercially. Among said essential components is a band 1 of connector contacts joined at their base 1*a* and comprising a curved portion 1*b* whose convex part is to be plated with a coating of precious metal. Said band 1 is guided by a cathode contact rail 3 against a shoulder 3*a* along which the base 1*a* of the band slides, held and drawn by a roller 4 in the direction of the arrow 2. A flap Slide 5 serves to hold the area 1*b* of the contacts against an elongated portion of a plating head 6.

Said plating head 6 consists of a prismatic body 7 of platinum-plated titanium covered with a static baize-type absorbent material 8, for example a sleeve of synthetic textile or of woven or expanded polymer, in particular of polypropylene, polyurethane, PVC, polyamide, polyester, polyacrylic or other such material. The front of the prismatic body 7 is in the form of a triangular prism 7*b*. The connectors to be plated are pressed by the slide 5 against an edge 7*a* of said triangular prism 7*b*, so that the area of the connector contacts 1*b* to be plated rests against the baize 8 covering the edge 7*a*. The prismatic body 7 comprises an electrolyte supply channel 9 connected at intervals to lateral ducts 10 that irrigate the baize 8. The electrolyte reaches the baize by way of openings 11 through a pad of a porous material 11*a* intended to regulate its flow. The prismatic body 7 is connected to an anode supply terminal, thereby activating the electrolyte passing through ducts 9 and 10 and enabling the metal dissolved therein to be electrodeposited on the contact area 1*b*.

During the operation of said plating cell, the band 1 advances while pressing against the edge 7*a* of the triangular prism 7*b*, and the baize 8 is supplied with pressurized electrolyte through channels 9 and 10 by way of pumping components not shown.

Such a design has certain limitations, owing principally to the flow of electrolyte into the baize. In order to preserve the selectivity of the plating, the flow of electrolyte must remain light so as not to inundate the baize and cause liquid to stream onto the pieces to be plated. A light flow of electrolyte results in rapid depletion of the concentration of metal ions in the plating area and premature electrolyte cooling because of an insufficient supply of new liquid, resulting in slow and not very economical plating. One prior attempt to remedy the cooling problem uses an additional duct 12 coaxial with channel 9, in which hot electrolyte (40–60 degrees C.) circulates continuously, but this improvement is still inadequate and cannot compensate for the rapid depletion of the metal in the plating area because of the low liquid flow rate therein.

Figure 2:
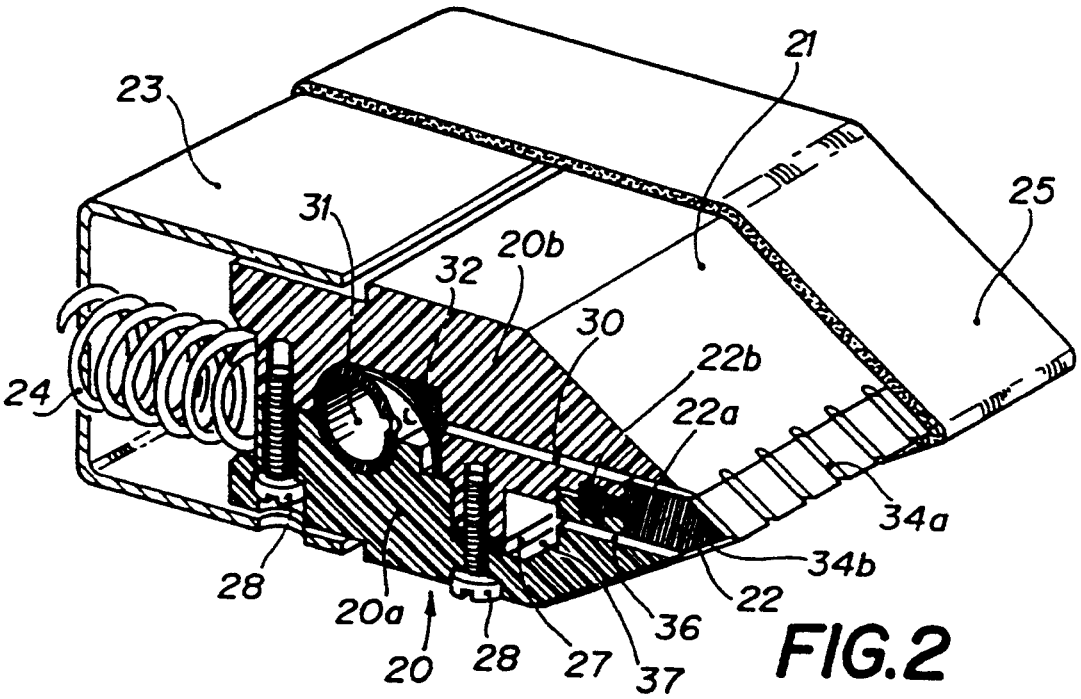
FIG. 2 is a perspective view of a form of execution of a plating head equipping a cell according to the invention.

The cell of this invention, illustrated in FIG. 2, eliminates the above-mentioned disadvantages.

Some of the components of this cell, in particular the band of contacts 1, the guide rail 3 and the slide 5, are identical to the prior embodiments; for this reason only the plating head is shown in FIG. 2.

Said plating head comprises a prismatic body 20 consisting of two acrylic parts 20*a*,20*b* held together by screws 28. The front of said body 20 consists of a triangular prism 21, while the back, having a rectangular cross section, is fitted into a U-shaped section 23. A sleeve of baize 25 envelops the prismatic body 20 and the section 23. A spring 24 placed between the back of the prismatic body 20 and the bottom of the section 23 serves to separate these two pieces one from the other and further serves to keep the baize sleeve 25 under tension.

The two parts 20*a*,20*b* forming the prismatic body 20 are shaped so as to create two longitudinal channels between them, one semi-cylindrical in shape in order to accommodate a perforated titanium tube 31 intended for connection to an electrolyte supply source as will be seen further on in the text, the other channel 37 serving to bring the excess electrolyte back to the supply source. A gasket 27 serves to separate these two channels.

Said two parts 20*a*,20*b* are likewise shaped for holding a separate longitudinal section 22 forming the dihedron of the front end of the triangular prism 21. Said longitudinal section comprises a plurality of paired grooves 34*a*,34*b* extending transversely on either side of the dihedron, the pairs being spaced longitudinally in respect of each other. Each groove 34*a* connects with one end of a duct 30 whose other end connects with the perforated tube 31 via a distribution grid 32. Each groove 34*b* connects with one end of a duct 36 whose other end opens into channel 37. Said section 22 is intended for connection to the + pole of the source of current and thus acts as an anode in the electrolytic coating process.

In addition to the two outer sides forming the dihedron of the triangular prism 21, the separate longitudinal section 22 comprises two sides adjacent to the ducts 30 and 36 respectively, a narrow part 22*a* ending in a mounting component 22*b* having a wider cross section than the narrow part 22*a*. Parts 20*a* and 20*b* are shaped in this area in a manner complementary to parts 22*a* and 22*b* of the separate longitudinal section 22, and therefore said section is integral with the prismatic body 20 after assembly and mounting of the two parts 20*a*,20*b* by means of screws 28.

Figure 3:
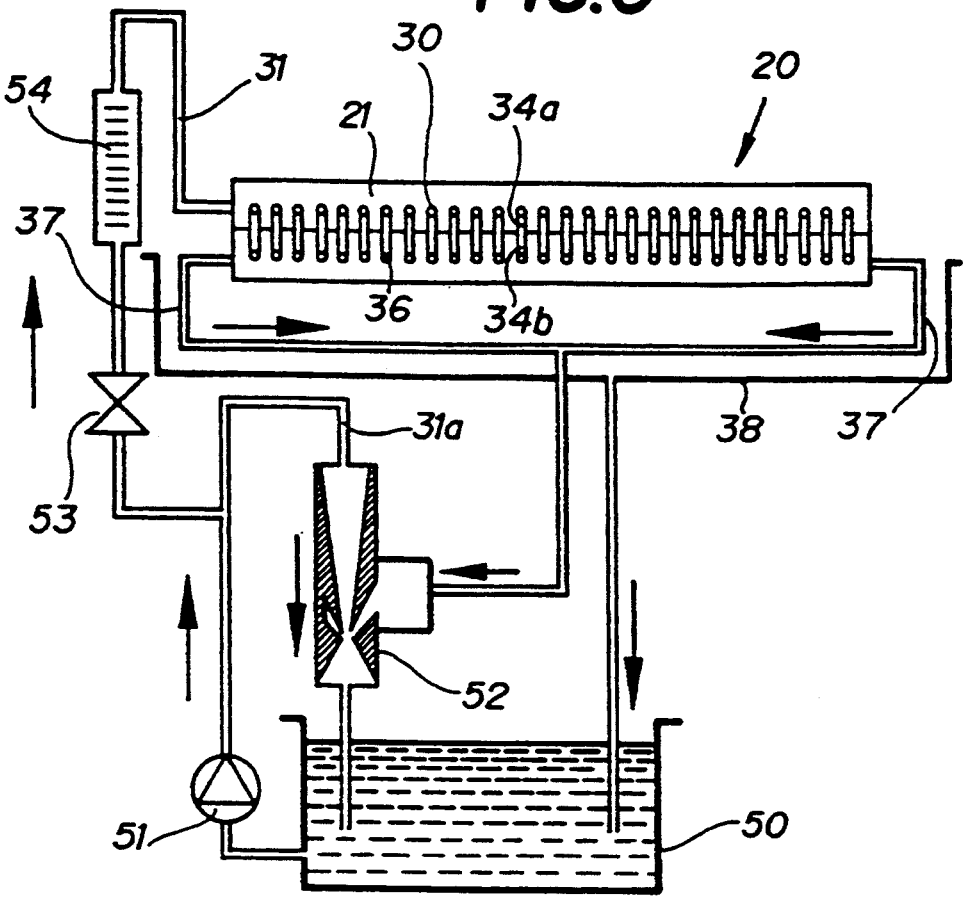
FIG. 3 is a diagram of the electrolyte supply circuit for the plating head illustrated in FIG. 2.

The electrolyte circulation circuit illustrated in FIG. 3 shows the prismatic body 20 seen from the plane of the bisector of the dihedral angle of the triangular prism 21. The grooves 34*a*,34*b* can be seen as well as the ducts 30 and 36 opening respectively into said grooves. Also shown are the supply duct 31 and the discharge channel 37, respectively entering and leaving the prismatic body 20.

Said circuit also comprises a heated tank 50 for holding the electrolyte, a pump 51 for keeping the electrolyte in constant circulation so that its temperature remains homogenous, and a venturi 52 connected both to the outlet of pump 51 via a branch duct 31*a* and to the discharge channel 37. The supply duct 31 is likewise connected to the outlet of pump 51 via a control vane 53. A flow meter 54 positioned downstream from the control vane 53 makes it possible to read the flow of electrolyte into the prismatic body 20. Finally, a recovery tank 38 serves to recover any losses of electrolyte, in particular during adjustment of the plating cell.

As a result of the venturi 52, a partial vacuum is created in the discharge channel 37 by the electrolyte circulated by pump 51. Said partial vacuum acts at the outlet of the ducts 36 at the bottom of the grooves 34*b* so that the excess electrolyte is evacuated into the ducts 36 and brought back to the tank 50 by way of the discharge channel 37. Through said evacuation of the excess electrolyte, it is possible to set a supply flow to grooves 34*a* by way of the ducts 30 connecting with the perforated tube 31 that is sufficient to maintain the electrolyte in the baize 25 at an appropriate temperature and to provide a constant supply of metal ions in the plating area in order to increase the speed of the electroplating, improve its quality and control the thickness of the coating.

Figure 4:
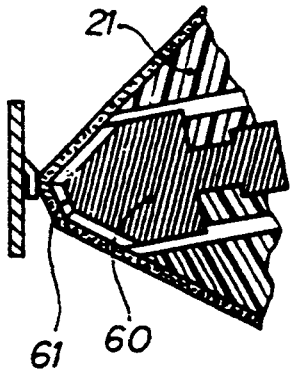
FIGS. 4 to 7 are partial cutaway views of several variations of the front end of the plating head of FIG. 2.
Figure 5:
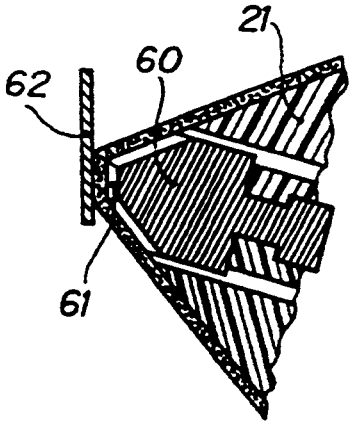

In the manner of execution illustrated in FIG. 2, the front end of the longitudinal section 22 is formed by the edge of the dihedron of the triangular prism 21. Depending on the shape of the piece to be coated as well as the surface of the piece to be plated, said edge may be truncated as illustrated in FIGS. 4 to 7. The section 60 in FIGS. 4 and 5 is cut along the intersection of a plane 61 inclined with respect to the bisector of the angle formed by the extension of the sides of the triangular prism 21. Said section 60 may be used as illustrated in FIG. 4, i.e. on an edge, which obtains the same effect as with the head in FIG. 2, or as illustrated in FIG. 5, wherein the plane 61 is in contact with the surface to be plated 62.

Figure 6:
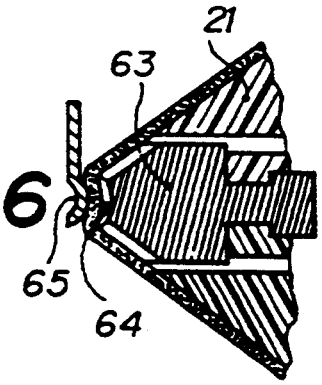
Figure 7:
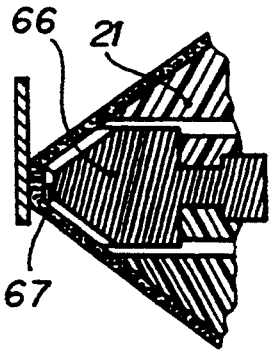

In the variation in FIG. 6, the front end of the section 63 is cut along the intersection of a concave surface 64, making it possible to plate a piece 65 with a complementary convex surface. Finally, FIG. 7 illustrates a section 66 whose front is truncated along the intersection of a surface 67 perpendicular to the bisector of the angle formed by the extension of the surfaces of the prism 21.

Generally speaking, the dimensions of the principal components of the plating head according to the invention are as follows:

Diameter of perforated tube 31, 10–30 mm; cross section of channel 37, 50–100 $mm^2$; diameter of ducts 30 and 36, 1–2 mm; length of the plating head 0.5 to 1 meter; overall electrolyte flow rate, 1,000–10,000 l/h; flow rate in supply duct 31, 100–800 l/h; current density, 10–30 A/dm$^2$; temperature, 45–65 degrees C.; speed of advance of the metal band, 1–50 m/min.

The following example was produced using a cell according to this invention:

EXAMPLE

The total quantity of the electrolyte, a gold-nickel bath with 12–15 g/l of gold, pH 4.4–4.6, was 150 l, and the overall flow rate ensured by pump 52 was 5,000 l/h.

A plating head 50 cm long was used, together with a baize 2.5 mm thick and an electrolyte flow rate at the head of 300 l/h; a temperature of 55 degrees C.; a current density of 18 A/dm$^2$; and a speed of advance of the pieces of 3–8 m/min.

Under these conditions, a Au-Ni deposit was obtained at a speed of about 5 microns/min. The useful thickness of the gold coating was about 0.5–1 micron.

The quality of the deposit (resistance to wear) and the precision of control of the coated surface were judged excellent.

I claim:

1. An electrolytic coating cell for forming a coating in a longitudinal track on a band of metal substrate adapted for connection to the negative pole of a source of current, said electrolytic coating cell comprising:

a plating head having an elongated prismatic body at least a longitudinal portion of said prismatic body being formed of a metal section and adapted for connection to the positive pole of the source of current, an outer surface of said metal section being covered with a layer of absorbent material a series of ducts distributed along the prismatic body and opening, near the layer of absorbent material, an electrolyte supply source, a supply circuit for said series of ducts, a pump for circulating pressurized electrolyte from the source through the supply circuit, means for bringing said metal substrate into contact with a longitudinal portion of the layer of absorbent material covering said metal section, means for producing longitudinal movement between said head and said substrate in order to form said longitudinal track, said plating head including a second series of ducts distributed longitudinally, opening near the absorbent layer, and a suction source connected to said second series of ducts.

2. A coating cell according to claim 1, wherein the two series of ducts distributed along said prismatic body are located respectively on each side of a longitudinal portion of the layer of absorbent material with which said metal substrate is adapted to be brought into contact, a succession of transverse channels connecting respectively each duct of one series to each duct of the other series.

3. A coating cell according to claim 1, wherein the two series of ducts are arranged one above the other, the series whose ducts are connected to the electrolyte supply source being above the series whose ducts are connected to the suction source.

4. A coating cell according to claim 1, wherein said prismatic body is divided longitudinally into two parts extending along either side of a longitudinal portion formed by said metal section and shaped so as to create two longitudinal channels between them, one of which connects both with the first series of ducts and with said electrolyte source and the other of which connects both with the second series of ducts and with said suction source said first and second series of ducts extending along either side of said section component.

5. A coating cell according to claim 1 wherein the shape of the outer surface of said section is adapted to be a function of the surface of the substrate to be coated and said section is mounted interchangeably on said prismatic body.

6. A coating cell according to claim 1, wherein said suction source includes a venturi connected to said pump by a branch duct intended to bring the pressurized electrolyte through the neck of the venturi into which a discharge channel opens, connecting said second series of ducts to the partial vacuum area of the venturi.

7. A coating cell according to claim 1, wherein the layer of absorbent material includes a flexible sleeve longitudinally covering the prismatic body the back of the latter being engaged in a U-shaped section a spring placed between the bottom of the U-shaped section and the back of the prismatic body serving to separate said two pieces one form the other, thus keeping the sleeve under tension.

8. An electrolytic coating cell comprising:

a plating head having a first and a second series of electrolyte ducts, a pressurized source of electrolyte connected to said first series of ducts, and a suction source connected to said second series of ducts;

wherein said first and second series of ducts are in fluid communication with each other as transverse channels distributed longitudinally along a prismatic body.

9. An electrolytic coating cell comprising:

a plating head having a first and a second series of electrolyte ducts, a pressurized source of electrolyte connected to said first series of ducts, and a suction source connected to said second series of ducts;

wherein the first series of ducts are disposed above said second series of ducts.

10. An electrolytic coating cell comprising:

a plating head having a first a and second series of electrolyte ducts, a pressurized source of electrolyte connected to said first series of ducts, and a suction source connected to said second series of ducts;

wherein said plating head includes separable upper and lower members and a central leading edge metallic member captured therebetween and including thereon at least part of each duct in said first and second series of ducts, said upper and lower members also defining a first longitudinal channel in fluid communication with said first series of ducts and a second longitudinal channel in fluid communication with said second series of ducts.

11. An electrolytic coating cell as in claim 10 wherein the shape of the outer surface of said leading edge metallic member is adapted to be a function of the surface of a substrate to be coated.

12. An electrolytic coating cell comprising:

a plating head having a first and a second series of electrolyte ducts, a pressurized source of electrolyte connected to said first series of ducts, and a suction source connected to said second series of ducts;

wherein said suction source includes a venturi connected to said pressurized source.

13. An electrolytic coating cell comprising:.

a plating head having a first and a second series of electrolyte ducts, a pressurized source of electrolyte connected to said first series of ducts, and a suction source connected to said second series of ducts;

wherein a flexible sleeve of absorbent material longitudinally covers the plating head which head is expandably spring-biased in a transverse direction to keep the sleeve under tension.

* * * * *

UNITED STATES PATENT AND TRADEMARK OFFICE

CERTIFICATE OF CORRECTION

PATENT NO. : 5,382,343
DATED : January 17, 1995
INVENTOR(S) : Eric ZWERNER

It is certified that error appears in the above-indentified patent and that said Letters Patent is hereby corrected as shown below:

ON THE TITLE PAGE:

Please change item [22] to read as shown below. Add after item [22], item [86] and [87] as shown below.

[22] PCT Filed: June 9, 1992

[86] PCT No.: PCT/CH92/00109
§371 Date: February 8, 1993
§102(e) Date: Feburary 8, 1993

[87] PCT Pub. No.: WO 92/22685
PCT Pub. Date: December 23, 1992

Signed and Sealed this

Twenty-ninth Day of September, 1998

*Attest:*

Bruce Lehman

BRUCE LEHMAN

*Attesting Officer*

*Commissioner of Patents and Trademarks*